US005131910A

United States Patent [19]

Breault

[11] Patent Number: 5,131,910

[45] Date of Patent: Jul. 21, 1992

[54] METHOD OF COLORING OR TINTING PAPER: ADDING RED, YELLOW AND BLUE DYES IN SELECTED PROPORTIONS TO BASE FURNISH

[75] Inventor: Jean-Guy Breault, Pointe Claire, Canada

[73] Assignee: Bayer (Canada) Inc., Canada

[21] Appl. No.: 719,062

[22] Filed: Jun. 19, 1991

Related U.S. Application Data

[63] Continuation of Ser. No. 421,795, Oct. 16, 1989, abandoned.

[51] Int. Cl.[5] ..... D06P 5/00; D21H 21/28; D21H 23/08

[52] U.S. Cl. ..... 8/400; 8/919

[58] Field of Search ..... 8/400, 919

[56] References Cited

FOREIGN PATENT DOCUMENTS 421172 4/1991 European Pat. Off. .
1477803 5/1989 U.S.S.R. .

OTHER PUBLICATIONS

Paper Technol. Ind. 27 No. 5 Aug./Sep. 1986 pp. 208-209, 211, B. E. Evans et al: "Closed-loop color control and papermaking dyes."
Database WPIL, No. 90-050579 Derwent Publications Ltd. London, SU-A-1477803 (Cell Paper Ind Prod).
Tappi Journal, vol. 55, No. 1, Jan. 1972, Atlanta US pages 140-144; J. A. Van Den Akker: "Spectral reflectance, transmitance, . . . ".

*Primary Examiner*—A. Lionel Clingman
*Attorney, Agent, or Firm*—Larson and Taylor

[57] ABSTRACT

The coloring or tinting of paper is achieved during the paper making process by adding at least one of only the three primary color dyes to a base furnish. The coloring or tinting provides a tighter control for any shade of white paper while maintaining maximum brightness and opacity. The control is obtained at a reduced cost compared to the use of fillers. The method comprises the steps of selecting a set of optical properties for a required paper representing luminosity value (L), red to green color difference value (a), and yellow to blue color difference value (b), measuring the L, a and b values of a base furnish, determining the deviations between the selected values and the measured values and adding at least one of only the three primary color dyes, yellow, red and blue, to the base furnish to achieve the selected set of optical properties for the required paper.

6 Claims, 8 Drawing Sheets

METHOD OF COLORING OR TINTING PAPER: ADDING RED, YELLOW AND BLUE DYES IN SELECTED PROPORTIONS TO BASE FURNISH

This application is a continuation, of application Ser. No. 07/421,795 filed Oct. 16, 1989, now abandoned.

The present invention relates to colouring or tinting of paper during the paper making process. More specifically, the present invention provides a method wherein a colour target for a paper is specified, and by adding at least one of only the three primary colour dyes to a base furnish, the colour target is achieved.

Tinting or colouring paper by the use of dyes has been in practice for many years. It is known that dyes tend to create an optical illusion. For example, when a blue dye is added the paper looks whiter.

A black dye makes a paper more opaque, and the human eye is more sensitive to the green portion of the spectrum. Thus these are the parameters that have been chosen to measure opacity. Black, violet and blue dyes were added. Black lowers the brightness across the entire spectrum, violet makes black with green or yellow and therefore also lowers the brightness and blue, generally a reddish blue is added to generate black with the natural beige colour of a base furnish.

Colour measurement prior to the 1980's was achieved primarily by measuring dominant wave length. The dyes were added, generally to the base furnish during the wet stage in the production of paper. Most dye additive systems in the past have monitored application of a single dye or a mixture of dyes but it is only recently that multiple dye additive systems have been developed.

The measurement of colour in paper is achieved by a number of presently available measuring devices. Most of these measure three parameters from the Hunter system or the CIELAB formula wherein L is the value for luminosity, "a" is the value for a colour tint between red and green, and "b" is a value of a colour tint between yellow and blue. By obtaining this information from a paper, one is then able to adjust the flow of dyes to the base furnish in the wet stage so that the selected colour target of paper can be achieved. In the past paper colours were allowed to be somewhat off shade, but they had to be consistent. Today one is able to achieve accuracy of shade and consistency for colour.

The aspects of colour measurement and the effects of dyes on the optical properties of paper have been known in the art for many years. Mason Hayek, in a paper entitled "Effect of Dyes on the Optical Properties of Paper" printed in Tappi, Volume 46, Number 5, May of 1963 discusses the effects of dyes on brightness, opacity, reflectance and other properties of paper. In this article, reference is made to a colour orientation chart showing the three primary colours in a triangle within a circle and explains that the complementary colour to each primary colour, which is a combination of the other two primary colours, absorb one another. However, the article suggests that in order to control the colour of paper, the paper maker must be provided with bright dyes of many hues. Hayek states that the most effective individual dyes for controlling opacity are black, violet and blue. Thus the paper maker is led to believe that the dyes that have to be used for tinting paper are not only those of the three primary colours, but dyes which are a combination of at least two of the three primary colours, black being a combination of the three primary colours.

In the production of paper, changes in criteria of wet stage conditions can result in changes of the physical and optical properties of the sheet as well as the effect of colour. Brightness in paper is directly related to lightness or luminosity and inversely related to opacity. While dyes cause a reduction in brightness, they increase opacity. Fluorescent brighteners give a paper a white appearance by absorbing light in the ultra-violet range and emitting brightness in the visible range. The addition of titanium dioxide to paper increases both opacity and brightness. Clays also increase opacity.

The individual opacifying power of a dye depends upon its spectral absorption curve. The most effective dyes show the maximum light absorption in the region of maximum sensitivity of the human eye which is 550 nm (nanometers), in the green range of the visible spectrum.

The most effective dyes are in decreasing order as follows: blacks, violets, blues, greens, reds and yellows. Violets are known to absorb around 550 nm and yellows around 420 nm. Blacks absorb across the whole spectrum between 400 and 700 nm. It is also known that in tinted white furnish containing pigment, the fibre, filler and dye, scatter and absorb light independently of one another, and the opacifying properties of dye in combination with fillers are advantageous as opposed to being used separately.

Pigment dyes are generally used for tinting fine paper. Like fillers they are insoluble, and are dependent on alum and/or retention aids to be retained in the sheet. Direct dyes, also known as substantive dyes or water soluble dyes, have an affinity for cellulosic fibre and to a lesser degree fillers. Direct dyes are retained by the fibres and in the case of deep shades, a cationic fixing agent such as alum may be necessary for their retention. Basic dyes are acid soluble cationic dyes which have affinity for lignin found in unbleached pulps. They are added to mechanical pulps containing lignin which are widely used in newsprint and ground wood specialty papers. Basic dyes are bright, but have a tendency to fade when exposed to light.

No two pulps have the same colours, and the brightness of pulp is very important especially when high brightness grades are produced. Low brightness pulp is usually yellower and the addition of tinting dyes and/or pigments tend to lower the brightness as the yellowness of the pulp is neutralized. In addition, the yield of direct dyes is dependent upon the species of wood used, whereas the yield of basic dyes is more dependent on the pulping process. Optical brighteners are usually less efficient on lower brightness pulps, and therefore the average demand per unit of brightness increases.

Brightness (TAPPI standard T452) is measured at an effective wavelength of 457 nm and is distributed throughout the spectral range of 400–500 nm. Since most white papers have a fairly flat reflectance curve from 550 to 700 nm, and slope down in the blue region of the spectrum, the blue reflectance increases as the sheet becomes whiter. For this reason, the brightness measurement takes into consideration only the blue portion of the visible spectrum.

If measurements of opacity and brightness are combined, it is found that white papers yield maximum brightness and opacity with dyes that yield maximum reflectance at 457 nm and maximum absorption at 550 nm.

Recycled and/or resued paper, referred to as broke, are one of the major causes of shade variation. This is mainly due to poor broke classification. Once a paper has been treated with additives to quench florescence, then it does not yield the same optical properties as when using virgin pulps. The colour and quality of broke can now be evaluated from the L, a and b values and used more efficiently.

It is known that colour variation in newsprint and other grades of paper may be reduced to almost imperceptible levels using on-line colour control techniques. One example of such a control system, among many, is made by Measurex Corporation. The system continuously measures the L, a and b parameters and provides dye flow adjustment to the base furnish. The system provides a single ratio flow in response to the measurement of brightness or fluorescence index and controls one or more dyes for the colour or tinting control. If required, newsprint can be made to a selected colour utilizing one or more dyes. In the past, as has been stated, the addition of dyes was controlled individually as was the addition of a brightening agent. As suggested in a paper published Apr. 21st, 1988 by the Australian Newsprint Mills Ltd. entitled "On-Line Colour Control for Mechanical Papers" authors Bonham, Flowers and Johnson; three dyes, green, violet and orange were mixed and applied to control the Hunter L, a and b values for some specific grades of newsprint pulp. These three colours are the complementary colours to the three primary colours, yellow, blue and red. To make other shades of paper, including coloured papers, or when using a different base furnish, other dye colours would have to be considered.

An object of the present invention is to select a three dye system, that, in combination, produces a neutral black and allows control of colour at any specific wavelength with minimum brightness loss. Any individual component cannot maintain the colour specifications of a standard at its maximum wavelength of brightness and opacity based on the permitted tolerance of that standard.

Furthermore, the purity of the individual components are such that they absorb light in at least one third of the visible spectrum, and reflect in the remaining portion. The three components allow ease of manual control of the L, a and b values, and by adjustments have a direct response on either the a value or the b value with little or no direct effect on the other.

It is an aim of the present invention to allow a tighter control on any shade of white, while maintaining maximum brightness and opacity within the established tolerance of the standard, and this control is obtained at a reduced cost compared to the use of fillers.

It has now been found, somewhat surprisingly in view of the teaching that has existed in the art for years, that by using the three primary colour dyes, yellow, red and blue, we are able to control not only the a and b values, but also the L value of paper in a manner that has not previously been practiced in the manufacture of paper. The primary colour dyes allow a far wider range of paper colours to be achieved. While the use of other dye colours give a variety of paper colours only, the three primary colours provide a wide optical property flexibility.

Based on the measurement systems for L, a and b, we are able to achieve more accurate control and consistency in the optical properties of the paper. Furthermore, by using the three primary colours, less opacifying agents and brighteners, such as titanium dioxide and other clays are needed. The addition of the three colours together produces black and conversely a reduction of the three colours provides a higher brightness level in the paper. The opacifying agents are expensive, so a reduction of these in paper manufacture results in a substantial saving to the paper maker.

By using a colour sensor on the paper after the final drying process, the reflectance spectrum of the paper is measured and figures which relate to the L, a and b values are determined. Utilizing these three values a dye metering system adjusts the dye flow of one or more of the yellow, red and blue dyes to control the L, a and b values to the target values with no other dye colours required.

By utilizing the three primary colours, the control may be manual, that is to say visual inspection or off-line colour measurement of paper samples, and controlling dye flow to the base furnish, secondly using a colour measuring device on-line, and then manual control of the dye flow pumps within desired parameters, or thirdly on-line measurement of the reflectance spectrum of the paper and computer control of the dye flow pumps. All three of these methods are not easily achieved with dyes that are not primary colours. For instance the on-line colour control mechanism in the Australian article appears to disclose selecting dye stuffs and assessing their suitability by means of a complicated series of mathematical equations based upon a pyramidal structure and its distances surrounding the target value. The Australian article teaches colour, and selection must be simplified by assuring that the addition of one of the colorants is zero or close to that figure. This yields less for the computer to control and in reality only controls the a and b values rather than the L, a and b values.

The present invention provides a method of colouring or tinting paper comprising the steps of selecting a set of optical properties for a required paper representing luminosity value (L), red to green colour difference value (a), and yellow to blue colour difference value (b), measuring the L, a and b values of a base furnish, determining the deviations between the selected values and the measured values and adding at least one of only the three primary colour dyes, yellow, red and blue, to the base furnish to achieve the selected set of optical properties for the required paper.

In drawings which illustrate embodiments of the invention,

Tinting dyes and/or pigments are generally used in the manufacture of paper to adjust the colour of white grades to a given standard. Pigments are generally used in fine paper due to their good light fastness properties at low dosages compared to other dye stuff groups. Basic dyes are generally used in ground wood papers due to their affinity for lignin. In one example the addition of a blue tinting dye to a furnish gives the impression of making the paper look whiter by absorbing the yellowish reflectance of the pulp, when in reality a slight decrease in whiteness occurs. The addition of an optical brightener has the effect of absorbing light in the ultra violet range and increasing reflectance in the visible spectrum. This results in increased brightness and whiteness. With regards to the term whiteness, this is the value of light reflectance measured in the whole visible spectrum situated between 400 and 700 nanometers. Brightness as defined by Tappi is the level of reflectance at a specific wavelength situated at 457 nanometers and is not recommended to measure papers containing an optical brightener. By using the primary colours, luminosity (L) is more accurately controlled and therefore has a more direct effect on brightness and opacity.

The effect of fillers like titanium dioxide and clay play a predominant part in the reflectance of paper in addition to their opacifying capabilities.

As stated in the paper published by the Australian Newsprint Mills, with the complementary colour dyes, such as violet, orange and green, it was not always possible to maintain or achieve the L, a and b values of a given standard due to variables caused by the base furnish. However, when the dyes are the primary colours, red, yellow and blue then a combination of one or more of only these three colours can maintain the L, a and b values. Primary colours have a more direct response to the control of these values than complementary colours.

A colour and brightness sensor such as the Measurex model 2250 has a colour space window with four colours, the three primary colours, yellow, red, blue and the colour green. From these four colours the colour coordinates are determined using the selected coordinate system, L being the luminosity from white to black, a the hue or shade for red to green, and b the hue or shade from yellow to blue. The figures achieved for a particular sample or specimen of paper from a paper machine is compared with a desired set of optical properties which are set by the paper users. The deviations for the three values from the selected optical properties are then used to control the flow of only the three primary colour dyes to the base furnish, for example in the wet stage of the paper machine.

Figure 1:
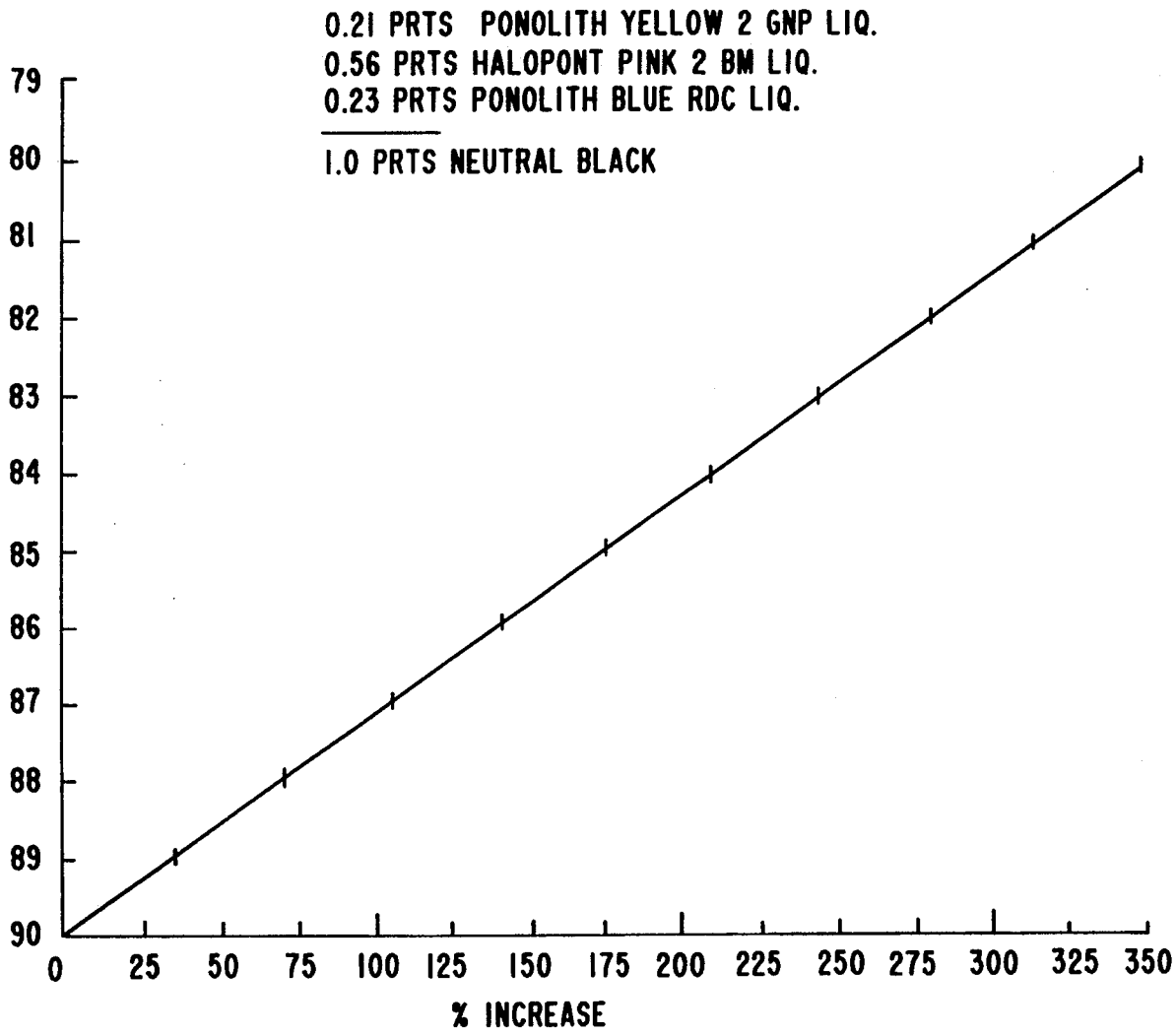
FIG. 1 is a graph showing an example of the effect of neutral black as a combination of the three primary colour dyes for brightness control.

As can be seen in the graph of FIG. 1, a combination of the three dyes produces a neutral black so an increase or decrease may be achieved by increasing or reducing the quantity of the three dyes in the ratio similar to that shown. Furthermore, by utilizing the variation of the three primary colours, yellow, red and blue the a and b values are controlled. Thus the three primary colours control not only the colour values a and b but also the luminosity value L.

The measurements of L, a and b values are achieved by a colour sensor, and the figures may be compared manually on a chart with the selected figures to suit the required optical properties of the paper. By setting the L, a and b values one is able to achieve the required opacity and brightness for a specific type of paper. The deviation figures are then used with the application of known formulas to control the flow of only the three colour dyes yellow, red and blue to the furnish. The formulas or equations are developed initially by trials to determine colour change effects point by point for the L, a and b values and combinations of these values. Alternatively the colour sensor may be set up on-line so that the paper in the dry state coming off the machine is continuously monitored and the parameters for L, a and b determined on a continuous basis, preferably over short intervals. From this information pumps for the three colour dyes may be controlled, and this takes into account colour variations that occur in the base furnish. A third manner of control is computer control, wherein the on-line measurement occurs from a colour sensor and the deviation figures between the measured values and the selected values are fed to a microprocessor to control the flow of dyes from the dye pumps in a closed loop system. Only one or more of the three primary colour dyes are applied.

The shift of the a and b values from one field to the other is observed carefully since the parameters are usually close to zero for whites or neutral greys. Once the standard values for a and b have been reached, it is important to check the lightness position against this standard. If the luminosity is higher, this could indicate that the opacity is too low, since luminosity and brightness are directly related. Opacity is inversely related to luminosity and brightness. A higher luminosity generally required an addition of dyes and conversely a lower luminosity a decrease in dyes.

TABLE 1

| | PHOTOCOPY PAPER 1 | BRIGHT WHITE 1 | PHOTOCOPY PAPER 2 | BRIGHT WHITE 2 | WHITE ENVELOPE | FORMS BOND | PHOTOCOPY PAPER 2 | PHOTOCOPY PAPER 3 | OFF-SET |
|---|---|---|---|---|---|---|---|---|---|
| F.I. | 81.27 | 81.97 | 81.55 | 80.06 | 85.15 | 81.89 | 81.55 | 84.84 | 87.90 |
| F.O. | 3.3 | 3.6 | 4.6 | 1.0 | 0.8 | 4.5 | 4.6 | 5.6 | 11.3 |
| | 84.57 | 85.59 | 86.13 | 81.07 | 85.97 | 86.37 | 86.13 | 90.43 | 99.21 |
| L | 93.15 | 93.57 | 93.78 | 93.68 | 96.02 | 94.88 | 93.78 | 95.41 | 95.69 |
| a | +0.3 | +0.4 | +0.4 | −0.1 | −0.1 | +0.5 | +0.4 | +0.9 | +1.2 |
| b | −0.5 | −0.7 | −0.9 | +3.0 | +3.3 | +1.0 | −0.9 | −1.2 | −6.4 |

Table 1 illustrates the desired properties of the L, a and b figures for a number of different papers as set by paper users. The L values of most white papers vary from 0 to 100. The examples shown are all in the 90's, and a preferred range is 80 to 100. The "a" range in these examples 50 is from −200 to 150 and the b range is from −100 to 150 for the Hunter system. The F.O. figures are the total florescence level of the paper sheet, F.O. is the figure with the filter out, F.I. is the figure with the filter in. The difference between these two figures is the degree of florescence. To comply with the requirements in the paper field today, the colour variability is determined from the formula:

$$\Delta E = \sqrt{[(\Delta L)^2 + (\Delta a)^2 + (\Delta b)^2]}$$

This measures the distance from the point in L, a and b space representing the colour of a sample to the point representing some reference. It is found that most people have trouble distinguishing colour differences less than about 0.5 units of Δ E. With the present colouring system, tolerances of 0.5 points total can be achieved in all three parameters.

TABLE 2

RELATIVE COLOUR VALUES WITH DECREASED BRIGHTNESS

| | BRIGHTNESS | | | | | | | | | | |
|---|---|---|---|---|---|---|---|---|---|---|---|
| | 90 | 89 | 88 | 87 | 86 | 85 | 84 | 83 | 82 | 81 | 80 |
| L | 96.7 | 96.1 | 95.5 | 94.9 | 94.3 | 93.7 | 93.1 | 92.5 | 91.9 | 91.4 | 90.8 |
| a | −0.31 | −0.29 | −0.27 | −0.25 | −0.23 | −0.21 | −0.19 | −0.17 | −0.15 | −0.13 | −0.11 |
| b | +2.60 | +2.61 | +2.56 | +2.49 | +2.42 | +2.35 | +2.20 | +2.21 | +2.14 | +2.07 | +2.00 |

Table 2 illustrates the relative colour values with decreased brightness. The brightness being measured as a reflectance of light from paper at the peak wave length of 457 nanometers. As can be seen, both brightness and the L value is controlled by increasing or decreasing black which is a combination of red, yellow and blue as shown in the graph, and the a and b values are controlled by increasing or decreasing individual or a combination of dyes. It will be apparent that green being a combination of blue and yellow, the "a" factor changes by a combination of the red, yellow and blue dyes.

FIGS. 2 to 7 aid in explaining why the three primary colours were chosen.

1) The right side of the vertical axis is the dosage in grams per ton. The left side is the corresponding L* value for each dosage.

2) The left side of the horizontal axis represents the changing a* value (right to left) with respect to dosage, while the right side represents the change in b* value (left to right).

3) The additional vertical Y axis is the actual CIE tristimulus measurement utilised in L, a and b calculations. It is directly indicative of opacifying power as it is measured between 500 and 600 nm. (The lower the number represents the greater the opacifying power).

The objective is to select components that by themselves have the least effect on brightness and opacity, but in combination have a direct effect, similar to black. This purity is exhibited by the fact that the selected colourants shown in FIGS. 2, 3 and 4 do not change from a positive to a negative field or vice-versa, in either a* or b* value, while FIGS. 5, 6 and 7 do change and cross the 0.0 scale. (It is noted that the −0.41 reading for a* value in FIG. 3 is for the base furnish).

| | | |
|---|---|---|
| Base Furnish | L* | 95.63 |
| | a* | −0.41 |
| | b* | +3.01 |

Figure 2:
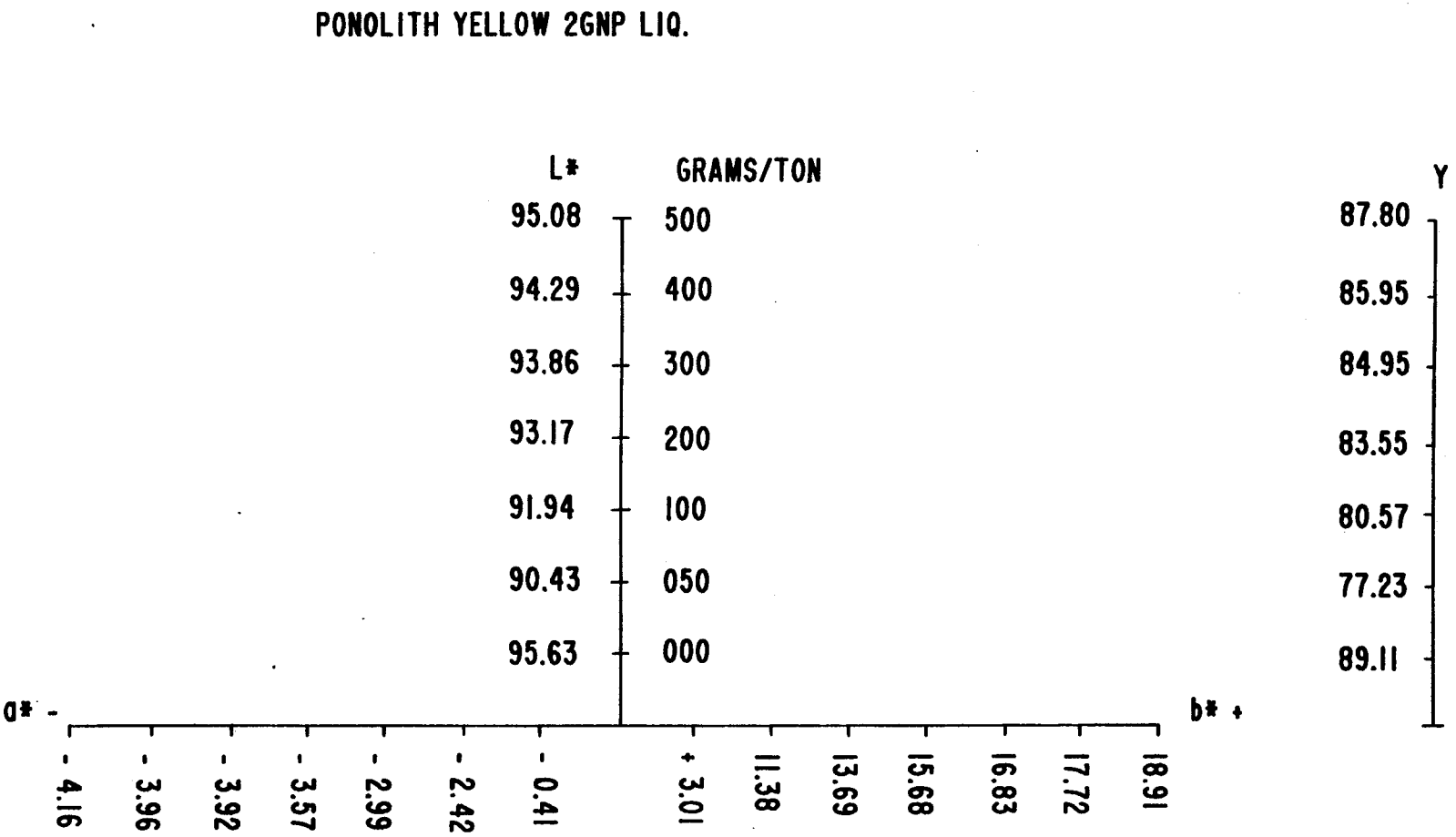
FIGS. 2 to 7 are diagrams explaining use of the three primary colour dyes.
Figure 3:
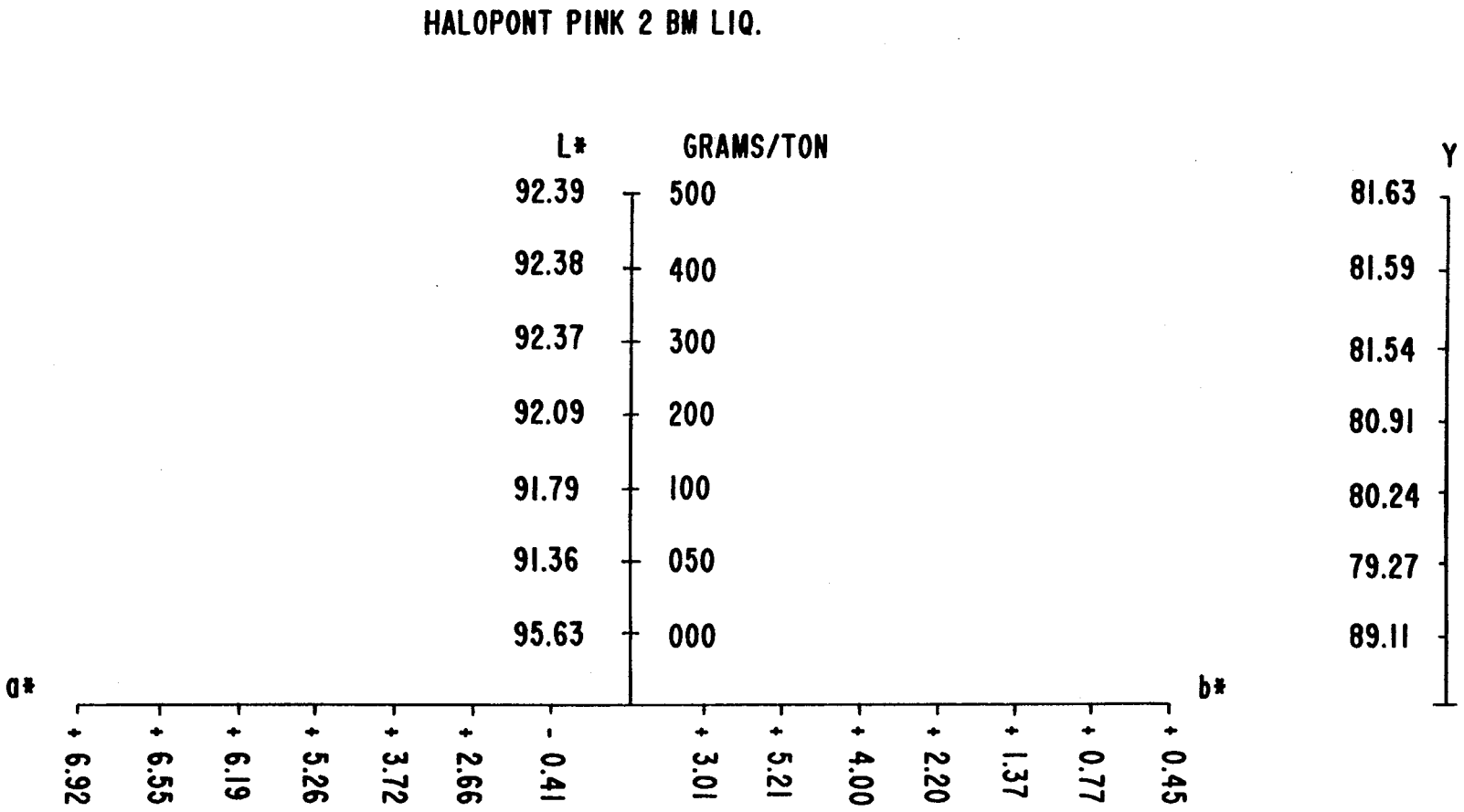
Figure 4:
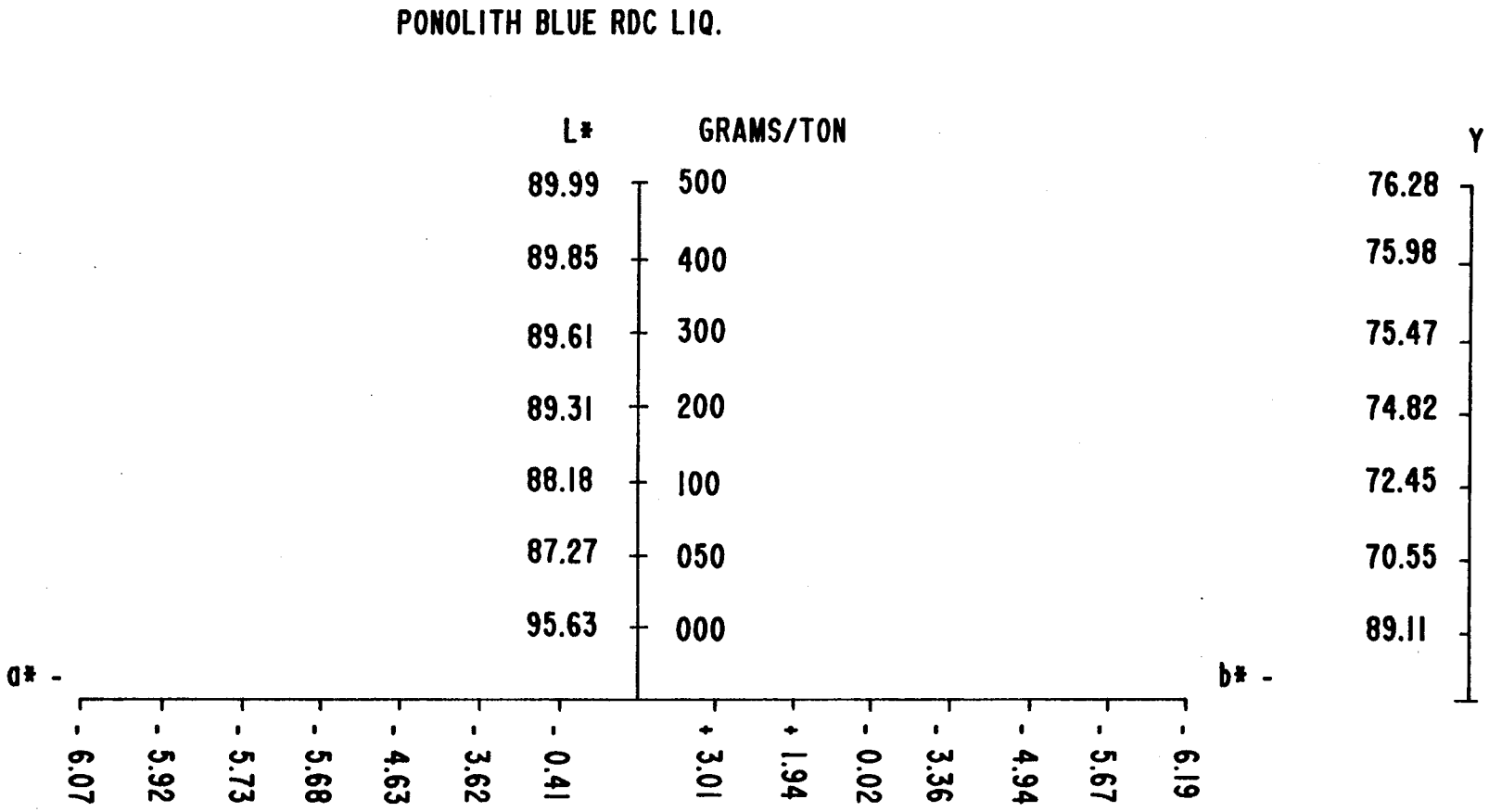
Figure 5:
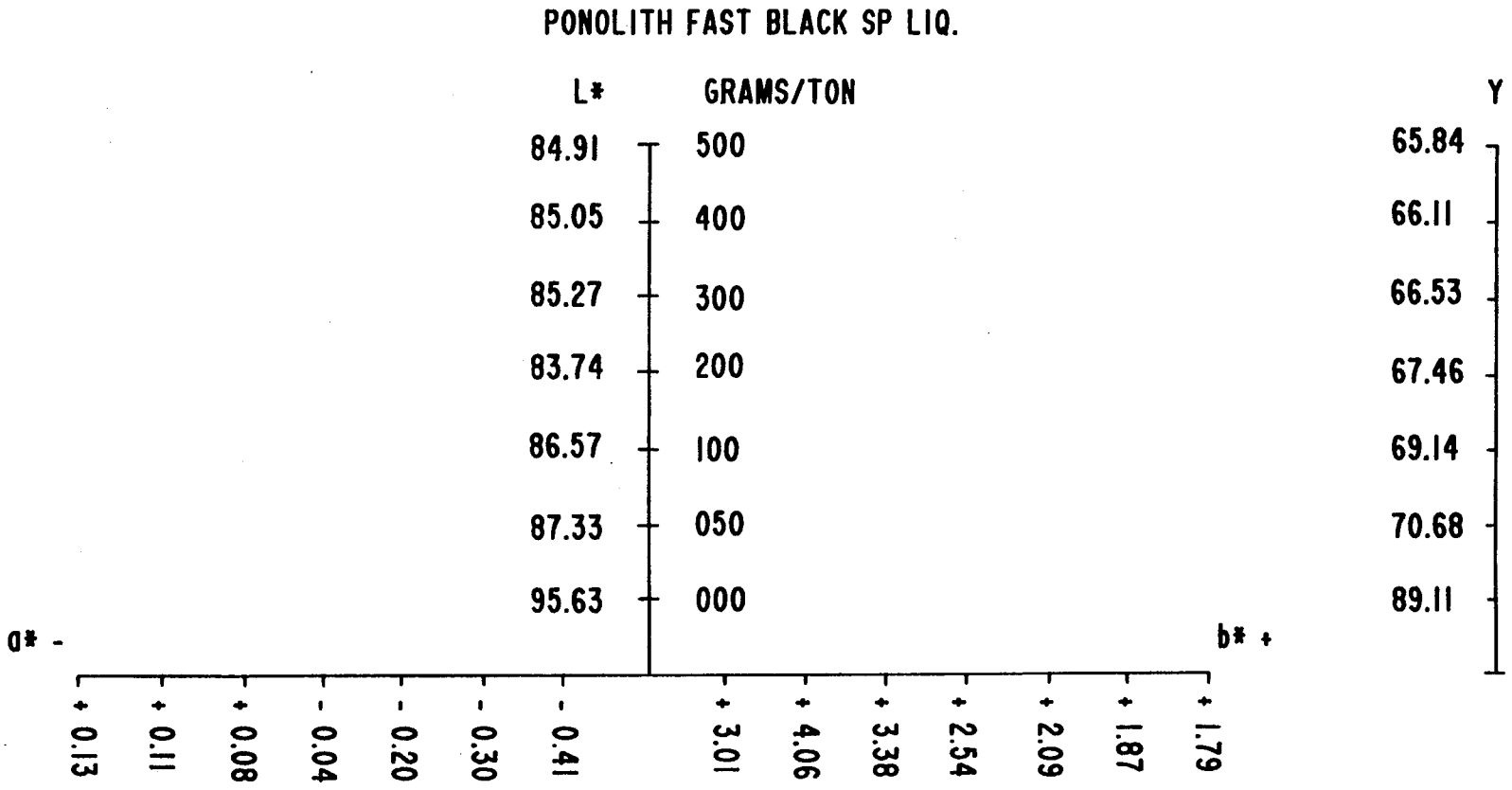
Figure 6:
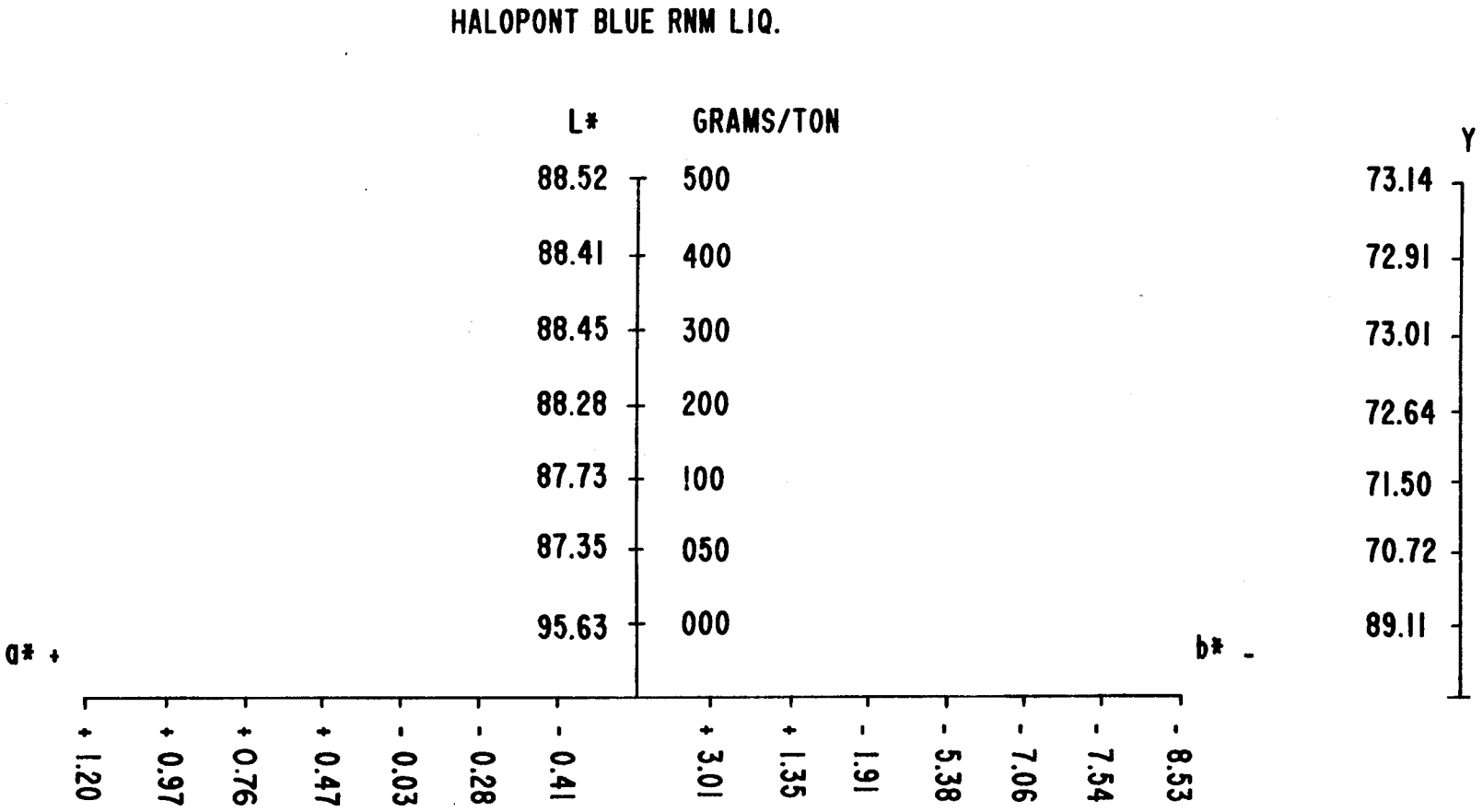
Figure 7:
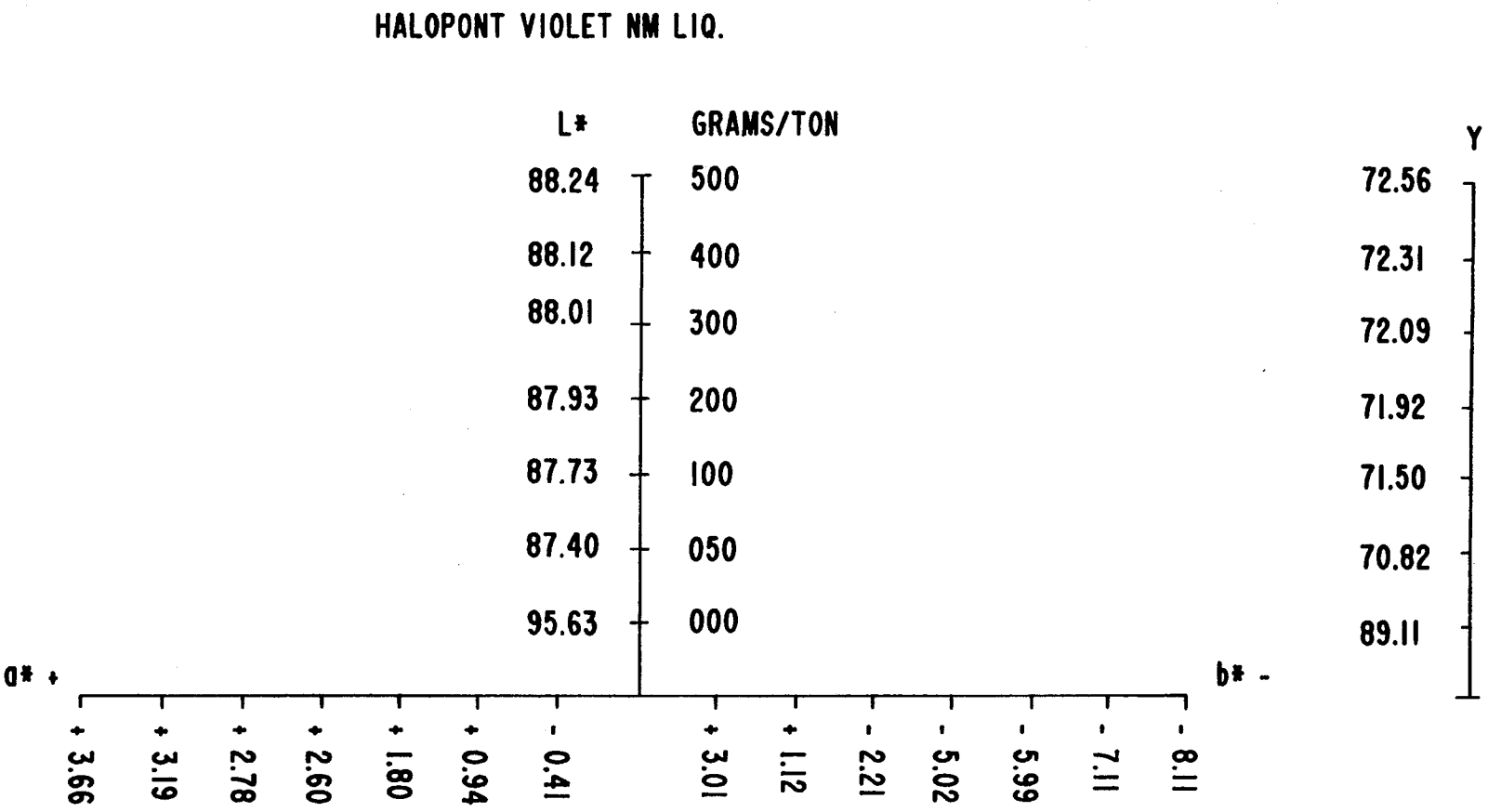

FIGS. 5, 6 and 7 are of the colourant types originally used in tinting fine papers while FIGS. 2, 3 and 4 represent colourants for fine paper applied according to the present invention.

The purity of the individual components has less effect on brightness and only in their combination can excess brightness be reduced to yield opacity. The system is suited to manual application, a combination of on-line measurement and manual application, or complete automatic close loop control. Furthermore, the system has a substantially infinite range with regards to colour, although as far as brightness is concerned the base furnish must have a sufficient brightness and opacity to allow control by means of the three primary colour dyes.

EXAMPLE 1

| | |
|---|---|
| Grade produced: | 44 grams newsprint |
| Optical properties | |
| Brightness | 59.0 ± 1.0 |
| % Print Opacity | 96.0 ± 1.0 |
| % Saturation | 5.0 ± 1.0 |
| Dominant wave length nm 581 ± 1.0 | |

This example demonstrates the maximum gain of opacity within the above specifications, and establishes an L, a, b, target once the maximum gains were achieved. This was done by targeting the dominant wavelength towards 580 nanometers (i.e. the greener side of the tolerance) and adjusting the saturation towards 4.5 which is the bluer side.

Prior to the test of the present invention, the mill was using 90 grams/ton of a mixture of 95 PARTS VIOLET and 5 PARTS GREEN.

Over a 24 hrs trial the consumption was the following:

| | |
|---|---|
| 5–10 grams/ton | Yellow |
| 24–40 grams/ton | Red |
| 95–115 grams/ton | Blue |

In order to adjust the brightness without changing the colour, a ratio of 4:1:1 of the above was used to make a neutral black.

| Results: Standard | Before | After |
|---|---|---|
| Brightness 59.0 ± 1.0 | 58.5 | 58.4 |
| % Print Opacity 96.0 ± 1.0 | 94.5 | 95.5 |
| % Saturation 5.0 ± 0.5 | 5.2 | 4.5 |
| Dom. wavelength 581 nm ± 1.0 | 583.2 | 580.5 |

Based on results obtained, a gain of 1 point Print Opacity was achieved with no significant change to the brightness. In addition, the colour remained within specifications as compared to pre-trial figures.

CIELAB figures at the optimum brightness and opacity level were the followings:

$$L^* = 82.5 \quad a^* + 0.9 \quad b^* + 3.8$$

Figure 8:
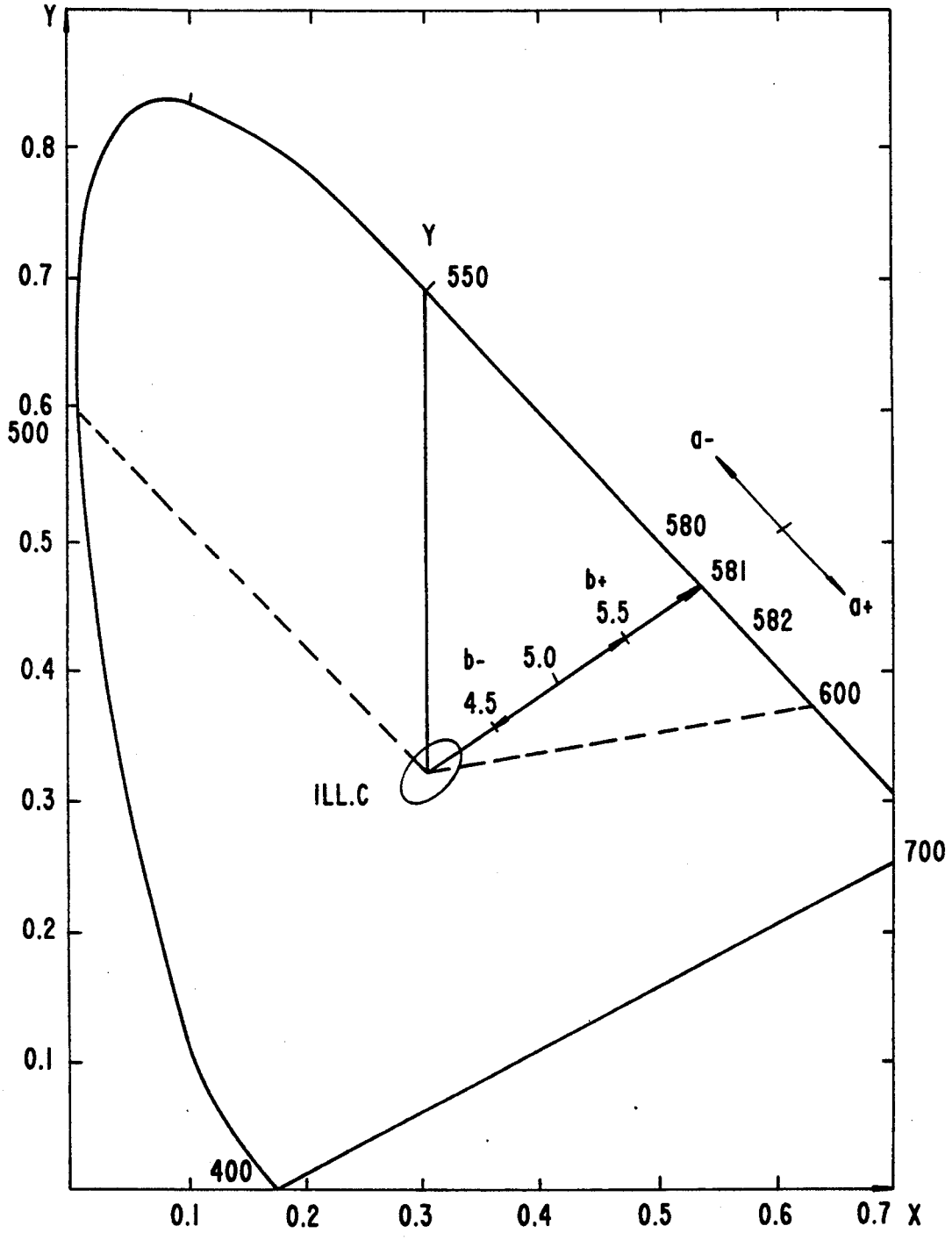
FIG. 8 is a graph showing the orientation of L, a and b values for Example 1.

FIG. 8 shows the orientation of L*, a*, b* in regards to dominant wavelength and saturation plotted on the C.I.E. tristimulus diagram.

During the test of the present invention the Δ E remained below 0.5 with the use of the Δ L*, a*, b* chart.

The CIELAB conversion equations are shown below for illuminant C.

$$L^* = 116\,(Y/100)\,1/3 - 16$$
$$a^* = 500\,[(X/98.04)\,1/3 - (Y/100)\,1/3]$$
$$b^* = 200\,[(Y/100)\,1/3 - (Z/118.1)\,1/3]$$
$$\Delta E^* = [(\Delta L^*)^2 + (\Delta a^*)^2 + (\Delta b^*)^2]\,1/2$$

This trial has shown that the method of the present invention generates opacity with little effect on brightness simply by adjusting the colour specifications, within tolerance where maximum brightness and opacity are obtained. Based on previous trials performed at this mill, the relative cost ratio between the use of filler clay, and the present method was in the neighborhood of 4:1.

EXAMPLE 2

The object of example 2 was to produce an alkaline photocopy paper with 2 points of fluorescence by using an optical brightener.

Experience has shown that optical brighteners absorb UV light between 300–400 manometers and have a peak reflectance at 440 manometers which translates into increased whiteness. This also has an effect of making the colour of the paper more violet (i.e.: redder and bluer) when expressed into CIELAB L*, A*, B* measurements.

GRADE SPECIFICATIONS

| | |
|---|---|
| Basis weight | 75 G S M |
| Brightness | 82.0–84.0 with 2% fluorescence |
| Opacity | 86.0–89.0 |
| Ash | 11–13% |
| L* | 91.0 ± 0.5 |
| a* | 0.0 ± 0.3 |
| b* | +1.0 ± 0.3 |

RESULTS

With a pulp brightness of 87.0 and a sheet ash of 11% (as Calcium carbonate), an average brightness of 92.0 was obtained. In this test, the brightness was lowered to the grade specification of 82.0 UV filter in allowing 2 points of fluorescence with UV filter out.

Opacity increased from 86.0 to 91.0 which is well above specifications.

In alkaline paper manufacture, opacity is generally within specifications, but the increased sheet ash can be detrimental with respect to dusting during the printing process.

Lighter basis weights are usually affected by poor ash distribution, and higher sheet density, resulting in losses of opacity.

The method of this invention allows better control of sheet ash and allows for the same opacity with reduced ash levels if necessary.

EXAMPLE 3

| | |
|---|---|
| Grade produced: | Xerographic |
| Basis weight | 71 grams |
| Brightness (UV Filter in) | F.1. 79.5 |
| (UV Filter out) | F.0. 82.5 |
| Opacity | 87.5–89.5 |
| Ash | 9.5–11.5 |
| L | 91.0 ± 0.5 |
| a | +0.5 ± 0.3 |

-continued

| | |
|---|---|
| b | +1.2 ± 0.3 |

In this example, a combination of regular clay (81–84 brightness) and titanium dioxide (98 brightness) were used to achieve the brightness and opacity requirements.

Because this grade requires very tight control on filter in and filter out, brightness difference with the use of optical brightener sometimes requires an increase of titanium dioxide. This allowed for achieving the filter in brightness when the pulp brightness was too low, or for meeting opacity requirements which represented an additional cost of 40–50 dollars per ton.

With the introduction of the method according to the present invention, it was possible to either eliminate the titanium dioxide, or reduce its consumption below 50% when the base brightness was too low.

NOTE: Mixed stock brightness of 82.0 yielded approximately 80.0 or lower because of drying conditions, size press starch, calendering, and dissolved contaminants in the white water.

During this test, the opacity results remained above specifications and therefore the existing clay at 84.0 brightness was substituted for a higher brightness clay in the area of 92.0 which allowed for replacing titanium dioxide in this grade.

This substitution resulted in savings of $30–$40 dollars per ton of paper.

The method of the present application has proven to be the most effective in paper mills with frequent paper grade changes whether on-line or manual colour control was used.

On-line colour control has a faster response to correction, and compensates for any colour fluctuations caused by variables in wet end additives and grade mix formulation.

Manual adjustments have a slower response, due to the number of attempts required to adjust colour within the grade specifications, because L, a, b, values describe colour difference as a distance of a sample to a standard. An A.C.S. reflectance spectrophotometer is usually given preference because it has the advantage of giving the quantity of the individual dyes required for the correction.

Once the colour parameters are within tolerance of the colour specifications, L, a, b, values are more easily controlled if the components chosen have a direct response for their adjustments.

Since records of formulations are kept for future runs the L, a, b, measurement is usually sufficient for proper colour control.

In addition, it has been found that the process of the present invention, when manually controlled, has the additional advantage of indicating other paper making variables. This is because the present invention takes into consideration the colouristic value of all additives used in the process, and the 3 components can be used as tracers or indicators of change, in addition to adjusting the colour parameters. Therefore, prior to making a change in the addition of the colour components, it may be necessary to adjust other auxiliaries used. By this adjustment, both the physical and optical properties of the sheet are obtained.

One distinct difference between the present invention and other methods of colouring, is in the ability of controlling other paper making variables in addition to colour. Brightness and opacity are the prime objectives of control as well as many others.

Examples of dyes used for fine paper are:

| | | | |
|---|---|---|---|
| PONOLITH | YELLOW | 2GNP | LIQUID |
| HALOPONT | PINK | 2BM | LIQUID |
| PONOLITH | BLUE | RDC | LIQUID |

for grades that contain mechanical pulp:

| | | | | |
|---|---|---|---|---|
| ASTRA | YELLOW | 4GN | LIQUID | 125% |
| ASTRA | RED | P | LIQUID | |
| ASTRA | BLUE | GSE | LIQUID | |

The above dyes are supplied by Bayer (Canada) Inc.

Various changes may be made to the embodiments described herein without departing from the scope of the present invention which is limited only by the following claims.

The embodiments of the invention in which an exclusive property or privilege is claimed are defined as follows:

1. A method of accurately controlling the optical properties of paper wherein the controlled optical properties consist of luminosity (L), color tint value between red and green (a), and color tint value between yellow and blue (b), the steps comprising determining the desired L, a and b values for the paper to be formed from a base furnish, measuring the L, a and b values of the base furnish, adding color dyes to the base furnish in an amount and proportion to alter the a and b values of the controlled optical properties from the measured values to the desired values, the color dyes added being selected from the primary colors consisting of red having a maximum reflectance within the range of about 600 to 700 nanometers, and a maximum absorption within the range of about 500 and 600 nanometers, yellow having a maximum reflectance within the range of about 500 and 700 nanometers, and a maximum absorption within the range of about 400 and 500 nanometers, and blue having a maximum reflectance within the range of about 450 and 550 nanometers and a maximum absorption within the range of about 600 and 700 nanometers, measuring the L value of the base furnish to determine the deviation of the L value from the desired L value, and adjusting the quantity of dyes added to the base furnish to increase or decrease respectively the L value while maintaining the proportion of primary dye colors to maintain the desired a and b values.

2. The method according to claim 1 wherein the L, a and b values are measured on a colour sensor and the deviations between the selected values and the measured values are used to manually control pumps feeding at least one of the three primary colour dyes, yellow, red and blue to the base furnish to achieve the selected set of optical properties for the required paper.

3. The method according to claim 1 wherein the L, a and b values are measured by an on-line colour sensor for paper produced on a paper making machine, the deviations between the selected values and the measured values are determined at preset intervals and used to manually add at least one of the three primary colour dyes, yellow, red and blue to the base furnish to achieve the selected set of optical properties for the required paper.

4. The method according to claim 1 wherein the L, a and b values are measured by an on-line colour sensor for paper produced on a paper machine, the deviations between the selected values and the measured values are determined at preset intervals, and signals representative of the deviations are fed to a computer means and closed loop system to add at least one of the three primary colour dyes, yellow, red and blue to the base furnish to achieve the selected set of optical properties for the required paper.

5. The method according to claim 1 wherein the L values are in the approximate range of 80 to 100.

6. The method according to claim 1 wherein the tolerance for the L, a and b values are within 0.5 units of the selected values of optical properties for the required paper.

* * * * *